US007623629B2

(12) United States Patent
Ito et al.

(10) Patent No.: US 7,623,629 B2
(45) Date of Patent: Nov. 24, 2009

(54) TRANSMISSION TYPE X-RAY TUBE AND MANUFACTURING METHOD THEREOF

(75) Inventors: Yuichi Ito, Chiba (JP); Toru Moriike, Chiba (JP); Seiji Hosoya, Chiba (JP); Yoshihiko Dan, Chiba (JP); Makoto Otsuka, Chiba (JP)

(73) Assignee: Hitachi Medical Corporation, Tokyo (JP)

( * ) Notice: Subject to any disclaimer, the term of this patent is extended or adjusted under 35 U.S.C. 154(b) by 0 days.

(21) Appl. No.: 11/547,721

(22) PCT Filed: Mar. 31, 2005

(86) PCT No.: PCT/JP2005/006279

§ 371 (c)(1),
(2), (4) Date: Oct. 6, 2006

(87) PCT Pub. No.: WO2005/098893

PCT Pub. Date: Oct. 20, 2005

(65) Prior Publication Data

US 2007/0211862 A1 Sep. 13, 2007

(30) Foreign Application Priority Data

Apr. 7, 2004 (JP) ..... 2004-113170

(51) Int. Cl.
*H01J 35/02* (2006.01)
*H05G 1/02* (2006.01)

(52) U.S. Cl. ..... 378/121; 378/140; 378/143

(58) Field of Classification Search ..... 378/119, 378/121, 136, 140, 143
See application file for complete search history.

(56) References Cited

U.S. PATENT DOCUMENTS

| | | | | |
|---|---|---|---|---|
| 2,090,636 | A * | 8/1937 | Olshevsky | 378/143 |
| 2,329,318 | A * | 9/1943 | Atlee et al. | 378/200 |
| 2,952,790 | A * | 9/1960 | Steen | 378/139 |
| 5,391,958 | A * | 2/1995 | Kelly | 313/420 |
| 5,515,412 | A * | 5/1996 | Shida | 378/121 |
| 6,044,130 | A * | 3/2000 | Inazura et al. | 378/138 |
| 6,351,520 | B1 * | 2/2002 | Inazaru | 378/138 |
| 6,487,272 | B1 * | 11/2002 | Kutsuzawa | 378/140 |
| 6,612,478 | B2 * | 9/2003 | Lee et al. | 228/107 |
| 6,661,876 | B2 * | 12/2003 | Turner et al. | 378/138 |
| 7,158,612 | B2 * | 1/2007 | Rusch et al. | 378/121 |
| 7,236,568 | B2 * | 6/2007 | Dinsmore et al. | 378/139 |

(Continued)

FOREIGN PATENT DOCUMENTS

JP 62-217533 9/1987

(Continued)

*Primary Examiner*—Edward J Glick
*Assistant Examiner*—Thomas R Artman
(74) *Attorney, Agent, or Firm*—Antonelli, Terry, Stout & Kraus, LLP.

(57) ABSTRACT

A transmission type X-ray tube includes an electrode lead (4) holding a cathode filament (7) and a stem unit (1) to which a sealing member (5), an exhaust tube (2), and the like are attached by brazing, and an irradiation widow frame (8) having an X-ray irradiation window (9) attached by brazing.

The other end side (52) of the sealing member (5) is attached to an open end (83) of the irradiation window frame (8) by welding.

Thus, it is possible to obtain a high-quality transmission type X-ray tube having a long service life at a low cost.

2 Claims, 11 Drawing Sheets

U.S. PATENT DOCUMENTS 7,382,862 B2 * 6/2008 Bard et al. ..... 378/121

FOREIGN PATENT DOCUMENTS

JP 07-006859 1/1995
JP 08-180823 7/1996
JP 09-180660 7/1997
JP 2001-266781 9/2001
JP 2002-025446 1/2002
JP 2002-042705 2/2002

* cited by examiner

TRANSMISSION TYPE X-RAY TUBE AND MANUFACTURING METHOD THEREOF

FIELD OF INVENTION

The present invention relates to an X-ray tube, and in particular to a transmission type X-ray tube and the manufacturing method thereof.

BACKGROUND ART

An X-ray tube is used as an X-ray source such as a medical X-ray device and a measuring device for industrial purposes. These X-ray tubes are classified broadly into rotating anode X-ray tubes and stationary anode X-ray tubes, and the previously mentioned transmission type X-ray tube belongs to the category of stationary anode X-ray tubes or to category of its own.

Recently, as disclosed in Patent Document 1, X-ray tubes have extended use application to an X-ray source in static eliminator.

Patent Document 1 relates to static eliminator and a method thereof for removing static electricity, and it removes static electricity on both sides of an object at the same time by radiating X-rays to the object.

In this manner, a removal of static electricity has become a significant issue in manufacturing or processing of products such as film or papers, filling of fine particles or liquid, and manufacturing or inspection process of devices such as semiconductor or display unit.

In Patent Document 2 a transmission type X-ray tube to use for static eliminator is described.

The transmission type X-ray tube described in Patent Document 2 is configured such that a ceramic stem unit held up with cathode pins and an X-ray window in which a target metal is deposited under the surface are supported by a ceramic bulb and bilaterally brazed, the focusing electrode is placed along the inner circumference of the ceramic bulb, and the lower end of the focusing electrode is held between the stem unit and the bulb.

Patent Document 1: JP-A-1995-6859

Patent Document 2: JP-A-1997-180660

DISCLOSURE OF THE INVENTION

[Problems to be Solved]

The transmission type X-ray tube disclosed in Patent Document 2 is characterized in the alignment of focusing electrode and also is able to secure voltage resistance. However, in the X-ray tube described in Patent Document 2 has a ceramic bulb between the ceramic stem unit and the X-ray window deposited with a target metal undersurface. This means that the ceramic parts are used in two places thus need to be handled with caution. Also, it is difficult to lower the cost in manufacturing the conventional X-ray tubes. It takes a good amount of time to manufacture them since both stem side and X-ray window side requires brazing. Also the operation process of the transmission type X-ray tube in Patent Document 2 is complicated since the brazing material used on the stem side and the X-ray window side needs to be different which makes it difficult to produce in large quantity. Furthermore, the brazing process of the X-ray window side and the ceramic bulb comes after the process of attaching a tungsten coil (cathode filament) to the cathode pin. Therefore the tungsten coil and the holding part of the cathode pin for holding the tungsten coil are exposed to high temperature by application of heat. As a result, the fixation of the tungsten coil and the cathode pin can become loose. There is a possibility that it will lack credibility due to degradation of durability and the characteristics of the filament.

[Means for Solving the Problems]

The above-mentioned problems can be solved by welding and joining the stem unit for maintaining the cathode filament formed by insulation material and the cupped irradiation window frame having the X-ray irradiation window at its closed end, also the other end of a tube-like sealing member of which one end is welded to the stem unit and the open end of the irradiation window frame.

The Effect of the Invention

In accordance with the invention related to claim 1, it is possible to braze the electrode lead, sealing member and exhaust tube all at once to the stem unit. Because the sealing member and the window frame are joined air-tightly by welding after the respective members are brazed, the step that involves the exposure of the cathode filament to high temperature during the production of the tubes is no longer necessary. This can also restrain the holding part between the cathode filament and the cathode lead from becoming loose since it does not get overheated. The invention had attained the production of a transmission type X-ray tube which is long lasting and high quality at a low cost while keeping the desired traits and long service life of the cathode filament.

In accordance with the invention relating to claim 2, the stem unit forming a cupped shape makes it easier to braze it to the sealing member, and because the height of the sealing member can be lowered the mechanical strength of completed X-ray tubes can be improved.

In accordance with the invention relating to claim 3, the joint of the stem unit and the sealing member can be blocked off from the electrode lead by a shield. For example, even when a metalized layer of the stem unit is evaporated while the tube is operating, the attachment of the evaporated metalized layer to electrode portions such as the electrode lead can be prevented and deterioration of voltage resistance can be restrained.

In accordance with the invention relating to claim 4, it excels in the insulation performance of the surface of the stem unit. The voltage resistance is improved and the heat resistance is also improved upon implementing silver-alloy brazing. Shaping and forming can be easily performed which leads to the improvement in productivity.

In accordance with the invention relating to claim 5, the fixation of the electrode lead is fortified and so the interval between the cathode filament and the irradiation window can be maintained with high precision, and the production of the transmission type X-ray tube with high quality, long service life and less fluctuation of focal spot size or linear power is made possible while preventing the fluctuation due to characteristics of the tube.

In accordance with the invention relating to claim 6, the material in the side that is affixed to the cathode filament can be freely selected without considering the fixation to the stem unit. This broadens the range of material selection, ensures more of the reliability in fixation, and improves its traits by securing the interval between the cathode filament and the irradiation window at a desired value.

Also, as for the material in the stem unit side of the electrode lead, it is possible to select the most suitable material for the fixation of the stem unit side without considering the influence on the fixation of the cathode filament, thus the working property can be improved.

In accordance with the invention relating to claim 7, the deformation in the foot of the cathode filament, deformation of the electron-releasing unit and displacement of the electron-releasing unit can be prevented upon joining the cathode filament and the electrode lead. Also, the interval between the cathode filament and the irradiation window can be precisely maintained and fluctuation due to characteristics of the tube can be prevented which leads to the attainment of the transmission type X-ray tube with high quality and long service life.

In accordance with the invention relating to claim 8, the production of the transmission type X-ray tube with high quality and long service life can be attained while keeping the desired traits and durability of the cathode filaments, by an effective combination of brazing and welding which prevents the joint portion of the cathode filament and electrode lead from being exposed to high temperature.

In accordance with the invention relating to claim 9, the welding operation is easy, and there is no deformation or subsidiary fracture of welded portions thus ensuring the reliability of airtight welding.

In accordance with the invention relating to claim 10, the cathode filament current can be made into a small current by the combination of application of heat and discharge of air in a chassis, thus enables the production of the transmission type X-ray tube with high quality and long service life while keeping the desired trait and durability of the cathode filament and preventing the fluctuation due to characteristics of the tube.

In accordance with the invention relating to claim 11, it is possible to braze the electrode lead, sealing member and exhaust hole to the stem unit all at once. Because the sealing member and the window frame are joined air-tightly by welding after the respective members are brazed, the step to expose the cathode filament to high temperature during production of the tubes is no longer necessary. This can also prevent the holding part between the cathode filament and the cathode lead from becoming loose since it does not get overheated. The invention had attained the production of a transmission type X-ray tube which is long lasting and high quality at a low cost while keeping the desired traits and long service life of the cathode filament.

BEST MODES FOR CARRYING OUT THE INVENTION

The transmission type X-ray tube in the present invention comprises the cathode filament for releasing electrons in a tube envelope from which the air is discharged. The tube envelope of the X-ray tube comprises an insulative stem unit, a frame having a window for irradiating X-rays at the front, a sealing member for joining the stem unit and the frame, and an exhaust hole.

The stem unit has a plurality of through-holes for penetrating electrode leads and an exhaust hole connecting to the exhaust tube.

The electrode lead that passed through the stem unit holds the cathode filament, making it face to the X-ray irradiation window in the X-ray tube. Also the electrode lead is connected to the end terminal outside of the X-ray tube for providing electric current to the cathode filament.

The frame and the X-ray irradiation window are affixed with brazing filler metal, the stem unit and the sealing member are affixed with brazing filler metal, and the sealing member and the frame are affixed by welding in which the welding member is dissolved.

Embodiment 1

FIG. 1~FIG. 3 are diagrams for illustrating embodiment 1 in the present invention of the transmission type X-ray tube. FIG. 1 (*a*) is a top view, FIG. 1 (*b*) is an elevational view, FIG. 1 (*c*) is a bottom view, FIG. 2 is a I-I line cross sectional view of FIG. 1 (*a*), and FIG. 3 is a partially enlarged view of FIG. 2.

In FIG. 1~FIG. 3, 1 is a cupped stem unit formed by an insulating material such as ceramic, 2 is an exhaust tube, 3 is an end terminal, 4 is an electrode lead, 5 is a tube-like sealing member, 7 is a filament having the negative electrode acting as the electron-releasing source (hereinafter referred to as a cathode filament), 8 is a cupped window frame, 9 is an irradiating window, 12 is an open end of the stem unit, 13 is a metalized layer, 41 is one end of a lead wire, 42 is the other end of the lead wire, 51 is one end of the sealing member, 52 is the other end of the sealing member, 71 is a foot portion of the cathode filament, 72 is the electrode-releasing portion of the cathode filament, 81 is a closed end of the window frame, 82 is an aperture provided at the closed end of the window frame, 83 is an open end of the window frame, 111 is an exhaust hole provided at the stem unit, 112 is one lead hole provided in the stem unit, 113 is the other lead hole provided in the stem unit, and 131 is a brazing filler metal.

Stem unit 1 is equipped with a plurality of through-holes including exhaust hole 111, lead holes 112 and 113 on closed end surface 11.

Exhaust hole 2 is formed by, for example, a copper tubing, one end side of exhaust hole 2 is brazed air-tightly to metalized layer 13 on bottom surface 114 of closed end surface 11 of stem unit 1 almost concentrically to exhaust hole 111, and the other end is implemented with hermetic sealing.

End terminal 3 is brazed to metalize layer 13 on bottom surface 114 of closed end surface 11 of said stem unit 1, almost concentrically to each of said lead holes 112 and 113. Electrode lead 4 inserts and perforates its one end side 41 through each of said lead holes 112 and 113 on closed end surface 11 of said stem unit 1, and is brazed to said end terminal 3.

Sealing member 5 is made of an electric conducting material (for example, such as kovar material, Fe, or Fe—Ni alloy), and its one end side 51 is brazed air-tightly to metalized layer 13 of open end 12 of said stem unit 1, as shown in FIG. 3 being enlarged. The dependability in the brazing of stem unit 1 and sealing member 5 is improved by forming metalized layer 13 at the end terminal of ceramic stem unit 1.

Shield 6 is affixed to the inner side of sealing member 5 almost concentrically, and blocks off the vicinity of brazing portion of one end side 51 of sealing member 5 and metalized layer 13 of open end 12 of said stem unit 1 and said electrode lead 4.

Both of foot portions 71 of cathode filament 7 are affixed respectively to other end sides 42 of said electrode lead 4. For example, this fixation is implemented by setting a concave portion at the end of said other end side 42 and placing and caulking foot portion 71 in this concave portion. Or, electrode lead 7 and the foot portions of the cathode filament may be affixed by welding.

Window frame 8 is formed with an electrical conducting material such as, for example, copper. This irradiating window frame 8 has an aperture at its closed end 81 almost concentrically to itself, and also equipped with irradiating window 9 for X-ray transmission being air-tightly brazed such that it blocks off this aperture 82. This irradiating window 9 is composed of materials such as, for example, Beryllium plate or Beryllium plate deposited with tungsten, and electrons emitted from the cathode filament are accelerated by high voltage of, for example, about 9 kilovolts, collide with this irradiating window 9 and generates X-rays. Meanwhile, open end 83 of irradiating window frame 83 is joined to other end side 52 of sealing member 5 by airtight welding. In this welding connection, window frame 8 is melted and affixed to sealing member 5 throughout the entire circumference. The arc welding is preferable to use for this welding connection, but need not to be limited to it.

Upon this welding connection, the interval between said irradiating window 9 and electron-releasing section 72 of said filament 7 is precisely set in predetermined measurement, and both of their centers are almost concentric to the tube axis.

With such configuration, an air-tight tube envelope is formed by parts such as electrode lead 4, end terminal 3, stem unit 1, exhaust hole 2, sealing member 5, window frame 8, irradiating window 9, and electrode leads 4 and end terminal 3 which block off lead holes 112 and 113.

In accordance with the configuration of embodiment 1, a plurality of components from the sealing member to stem unit can be brazed all at once. Also the irradiating window and the window frame can be brazed and shaped aside from the stem unit side. With the transmission type X-ray tube of the present invention, the cathode filament can be affixed to the electrode lead after the brazing. After affixing the cathode filament to the electrode lead, window frame 8 and sealing member 5 can be air-tightly welded. Therefore, since there is no brazing process after fixation of the cathode filament, the cathode filament does not have to be exposed to high temperature. As a result, the invention attains the production of a transmission type X-ray tube which is long lasting and high quality without fluctuation of focal point size or X-ray generating power while keeping the desired traits and long service life of cathode filaments.

Also, the present invention can provide the transmission type X-ray tube excelling in mechanical strength, productivity and low cost due to using the combination of the cupped stem unit formed of ceramic and the sealing member formed of conducting material.

Furthermore, the joint between the stem unit and the sealing member are defiladed from components such as the electrode lead by the shield. Even when the metalized layer of the stem unit is evaporated while the tube is operating, the attachment of the evaporated metalized layer to an electrode section of high voltage potential including the electrode lead can be prevented and deterioration of voltage resistance can be restrained as a result.

Embodiment 2

FIG. 4 is a cross sectional view for illustrating embodiment 2 of the transmission type X-ray tube of the present invention, and the same encoding is used for the sections which are the same as the previously described diagram.

In FIG. 4, stem unit 10 is composed of a flat plate. Stem unit 10 has metalized layer 13 on top surface 101 and the bottom surface 102, and first tube 151 formed by insulating material of sealing member 15 is air-tightly welded to top surface 101. This sealing member 15 is configured with the addition of ceramic tube 152 and said first tube 151 to sealing member 5 of FIG. 3, and each of ceramic tube 152, sealing member 5 and first tube 151 are air-tightly welded. Also, end terminal 52 on window frame 8 side of said sealing member 15 is air-tightly welded to open end 83 of window frame 8.

In accordance with the configuration of embodiment 2, the configuration of the stem unit is simple which makes it easy to produce a large quantity at a low cost. Furthermore, the welding of stem unit 10, first tube 151, ceramic tube 152 and sealing member 5 can be implemented at the same time as the other welding of electrode lead 4 and exhaust hole 2, etc. which means that the cathode filament does not need to be exposed to high temperature which enables production of the transmission type X-ray tube that is long lasting and high quality while keeping the desired traits and long service life of cathode filaments and preventing fluctuation due to characteristics of the tube.

Embodiment 3

FIG. 5 is a cross sectional view for further illustrating embodiment 3 of the transmission type X-ray tube of the present invention, and the same encoding is used for the sections which are the same as the previously described diagram.

In FIG. 5, stem unit 20 is composed of a flat plate. Stem unit 20 has metalized layer 13 formed on its outer surface 202 and bottom surface 203 of its top surface 201 side, and cup 251 of sealing member assembly 25 is air-tightly welded to outer surface 202. Sealing member assembly 25 here is configured by said cups 251 being placed symmetrically on both sides holding the second ceramic tube 252 therebetween and each of them being air-tightly brazed. The end terminal 253 of cup 251 being placed on the side of said window frame 8 is air-tightly welded to open end 83.

In accordance with the configuration of embodiment 3, the configuration of the stem unit is simple and excels in productivity at a low cost. The reliability of the hermetic joint can be improved by joining the surfaces of outer surface 202 of stem unit 20 and sealing member 25. Furthermore, the welding of stem unit 20, two cups 251 and the second ceramic tube 252 can be implemented at the same time as the other welding of parts such as electrode lead 4 and exhaust tube 2. It is possible in the transmission type X-ray tube of the present invention to affix the cathode filament to the electrode lead after brazing. After affixing the cathode filament to the electrode lead, window frame 8 and cup 251 can be air-tightly welded. Therefore, since there is no brazing process after affixing the cathode filament and the cathode filament does not have to be exposed to high temperature, it is possible to keep the desired traits and long service life of the cathode filament and to provide the transmission type X-ray tube which is high quality and long lasting while preventing the fluctuation due to characteristics of the tube.

Embodiment 4

FIG. 6 is a cross sectional view for further illustrating embodiment 4 of the transmission type X-ray tube of the present invention, and the same encoding is used for the sections which are the same as the previously described diagram.

In FIG. 6, sealing member 35 of this embodiment is configured with the addition of 2 shields 354 to the previously mentioned sealing member 25 in FIG. 5.

More specifically, sealing member 35 is configured so that shields 354 are respectively arranged in the position where they block off the welding portions of two cups 251 and second ceramic tube 252 from electrode lead 4.

Other configuration is the same as embodiment 3.

In accordance with configuration of embodiment 4, the joints of the second ceramic tube and the cups can be defiladed by shield 354 from parts such as electrode lead 4. Even when the metalized layer of the joint portion evaporates while the tube is operating, the attachment of the evaporated metalized layer to the electrode lead can be prevented, and the voltage resistance of the transmission type X-ray tube is improved as a result.

Embodiment 5

FIG. 7 is a cross sectional view for illustrating embodiment 5 of the transmission type X-ray tube of the present invention, and the same encoding is used for the sections same as the previously described diagram.

In this embodiment, electrode lead 14 is configured with conducting wires made of different materials being connected together.

In concrete terms, it has the configuration that supporting lead 141 for being connected with cathode filament 7 is made of, for example, molybdenum wire which is suited for welding, and outer lead 142 for being brazed with stem unit 1 and end terminal 3 is made of, for example, alloy of Fe29%-Ni17%-Co54% (proprietary name: Kovar).

In accordance with embodiment 5, the electrode lead and the cathode filament can be affixed infallibly, and the interval between the cathode filament and the irradiating window can be maintained at a desired value.

Also, the workability of the X-ray tube is improved since it is possible to select the materials for welding of the stem unit and the electrode lead without considering the influence to the fixation of the cathode filament.

Embodiment 6

Next, a manufacturing method for the transmission type X-ray tube of the present invention will be described as embodiment 6. FIG. 13 is a flow chart of the manufacturing process of the transmission type X-ray tube.

FIG. 8 is a cross sectional view showing the composition of the stem unit side for illustrating the embodiment for manufacturing method of the transmission type X-ray tube of the present invention, and the same encoding is used for the sections same as the previously described diagram.

In the manufacturing method of the present invention, in a mount assembling process, parts such as stem unit 1, exhaust pipe 2, end terminal 3, electrode lead 4 and sealing member 5 having shield 6 are assembled as shown in FIG. 8 and set in a jig. At this time, brazing filler metal is inserted to the respective brazing sections, and brazing filler metal which has about 750~900° C. of melting temperature such as silver-alloy brazing or silver-copper alloy brazing can be used. Also, the stem unit is provided with metalized layer 13 on each of bottom surface 114 and open end 12, and electrode lead 4 is formed having, for example, concave portion 421 for affixing foot portion 71 of cathode filament 7 at the edge of other end side 42.

The assembled parts set in the jig by above-mentioned process is brought in a furnace, and assembled by implementing the welding all at once by applying heat of 850° C. when silver-alloy brazing is used.

On the other hand as shown in FIG. 9, window frame 8 on closed end 81 side of window frame 8 is placed with irradiating window 9 holding the brazing filler metal made of the previously mentioned material therebetween, these parts are set in a jig, and assembled by heated and welded in the same manner as previously mentioned.

This brazing process can be carried out in the same furnace at the same time as previously mentioned brazing referring to FIG. 8 if necessary.

As for the brazing filler metal, different ones from FIG. 8 can be used considering factors such as cost and workability, but by using the same one in all of the welding portions of the X-ray tube can facilitate the production control.

Next, the mounting fixation of cathode filament 7 is carried out.

FIG. 10 is a diagram for illustrating this mounting fixation, and the same encoding is used for the sections same as the previously mentioned diagrams.

As shown in FIG. 10, mount assembly 16 is formed by first inserting foot portions 71 of cathode filament 7 in the concave portions 421 of the edge of other end side 42 of electrode lead 4 that is brazed and assembled until it touches the bottom of said concave portions 421 for positioning, then high-pressuring from outside, caulking and affixing by methods such as welding fixation. A variety of means can be used for said mount fixation.

Next, mount assembly 16 of which the mount fixation of cathode filament 17 is completed and the window frame assembly provided with irradiating window 9 are assembled concentrically as shown in FIG. 11. Line II-II is the tube axis of the transmission type X-ray tube. In the condition that the interval between cathode filament 7 and irradiating window 9 is secured at a predetermined value, open end 83 of irradiating window frame 8 and other end side 52 of shield member 5 are air-tightly welded by welding means such as electric-arc welding. In this manner the transmission type X-ray tube 17 that is not sealed (hereinafter referred to as unsealed tube) is formed.

FIG. 11 is a diagram for illustrating unsealed tube 17 formed by putting together mount assembly 16 and the assembly of the window frame, and the same coding is used for the sections that are the same as the previously mentioned diagrams.

Next, the exhaust ventilation in the tube of unsealed tube 17 is carried out. This exhaust operation is carried out using exhauster 18 shown in FIG. 12. FIG. 12 is a pattern elevational view illustrating an epitome of an example of the exhauster used for the manufacturing method of the transmission type X-ray tube in the present invention, and the same coding is used for sections same as the previously mentioned diagrams. This exhauster 18 has parts such as table 181, cover 182, exhaust system 183, heater 184 and exhaust pipe 185, and exhaust tubes 2 of unsealed tubes 17 are set on exhaust system 183. It is preferable that a plurality of unsealed tubes 17 is set at once for the sake of operation efficiency.

Exhaust operation is carried out from exhaust system 183 toward the direction of arrow 19 via exhaust pipe 185, by passing the filament current on the respective unsealed tubes 17 and activating an exhaust pump that is not shown in the diagram as applying the heat with heater 184.

Also, the temperature of the above-mentioned heating may be determined considering the material used for unsealed tubes 17, and is preferable to have, for example, more than 400° C. A variety of means other than previously mentioned can be used for a heating method.

When degree of the vacuum in the tube reaches, for example, $133\times10^{-6}$ Pa, exhaust tube 2 is pinched by the rollers not shown in the diagram, and the rollers are pressurized and rotated causing exhaust tube 2 to be air-tightly sealed.

After the airtight sealing, the transmission type X-ray tube as seen in FIG. 1 is manufactured in a way that exhaust tube 2 which is closer to the side of exhaust system 183 than air-tightly sealed portion being cut off and detached from exhaust system 183.

Here, in accordance with a configuration having an evaporative getter in the sealed tube, even higher vacuum condition can be provided by implementing getter flash after the previously mentioned airtight sealing.

In the case of placing a non-evaporative getter in the sealed tube, the getter can be revitalized during the exhaust process. Therefore, the getter flash process can be omitted in the case that a non-evaporative getter is used. Also, using non-evaporative getter can reduce the electron emission since the getter material does not stick to the parts such as the cathode filament.

In accordance with embodiment 6, cathode filaments can be mounted without exposing them to high temperature since the mount assembly and frame assembly are put together by welding. This makes it possible to secure the desired traits and long service life of the cathode filaments, prevent the fluctuation due to characteristics of the tube, and the production of transmission type X-ray tube that is long lasting, high quality at a low cost. Also, since the holding parts of the cathode filament and the electrode lead do not have to be exposed to high temperature, they can be restrained from becoming loose due to heat.

Also in the exhaust process, the exhaust efficiency can be improved and the higher vacuum can be obtained since exhaust operation is implemented by heating the sealed tube from outside as passing the filament current, which lead to the production of the transmission type X-ray tube that is long lasting and high quality at a low cost.

DESCRIPTION OF SYMBOLS

Figure 1:
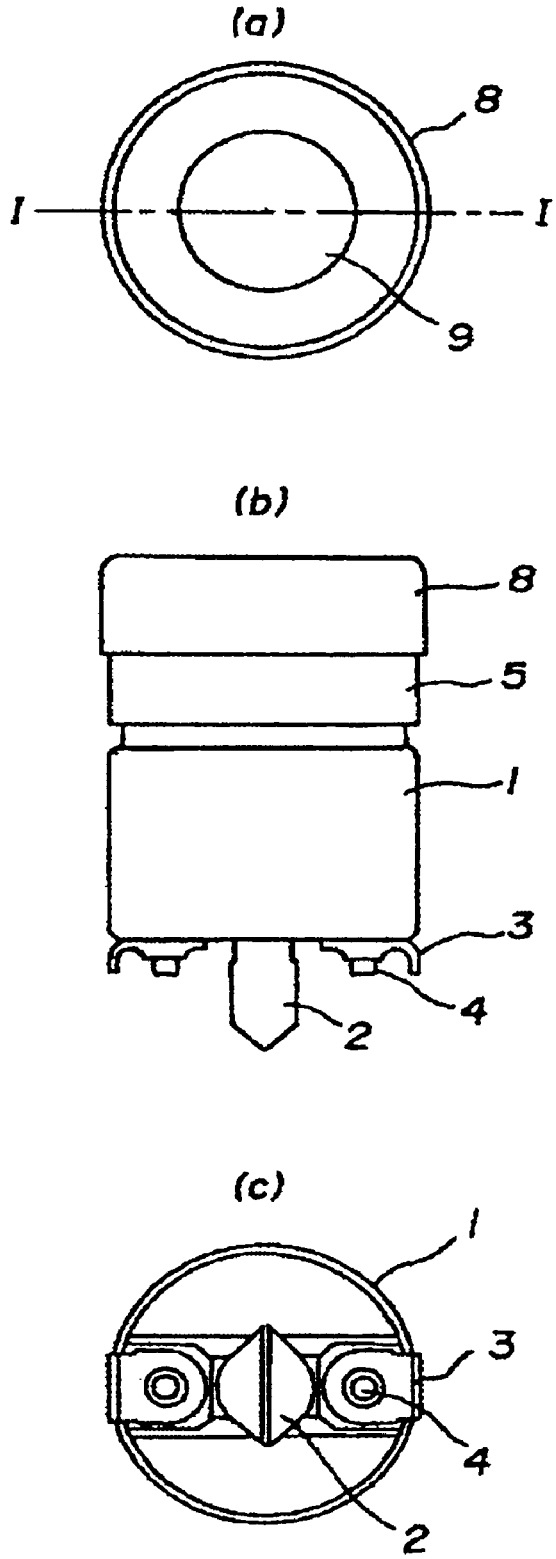
FIG. 1 illustrates an embodiment of the transmission type X-ray tube in the present invention, and FIG. 1 (*a*) is a top view, FIG. 1 (*b*) is a front view and FIG. 1 (*c*) is a bottom view.
Figure 2:
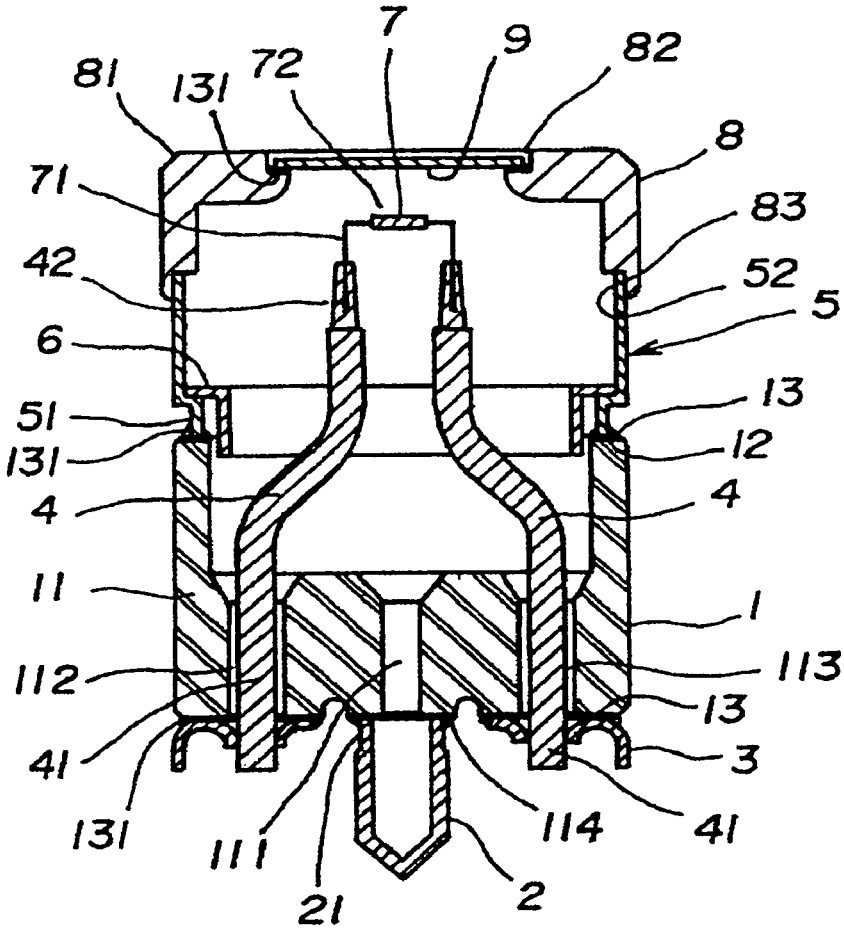
FIG. 2 is a sectional front view of FIG. 1 (*a*) along I-I line.
Figure 3:
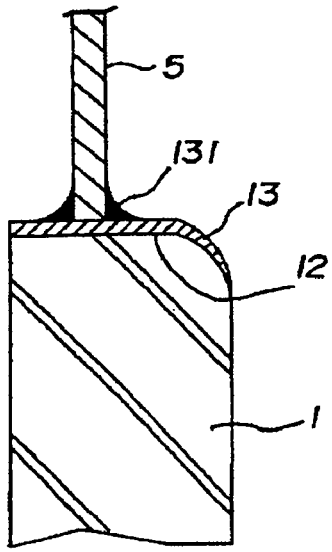
FIG. 3 is a partial enlarged view of FIG. 2.
Figure 4:
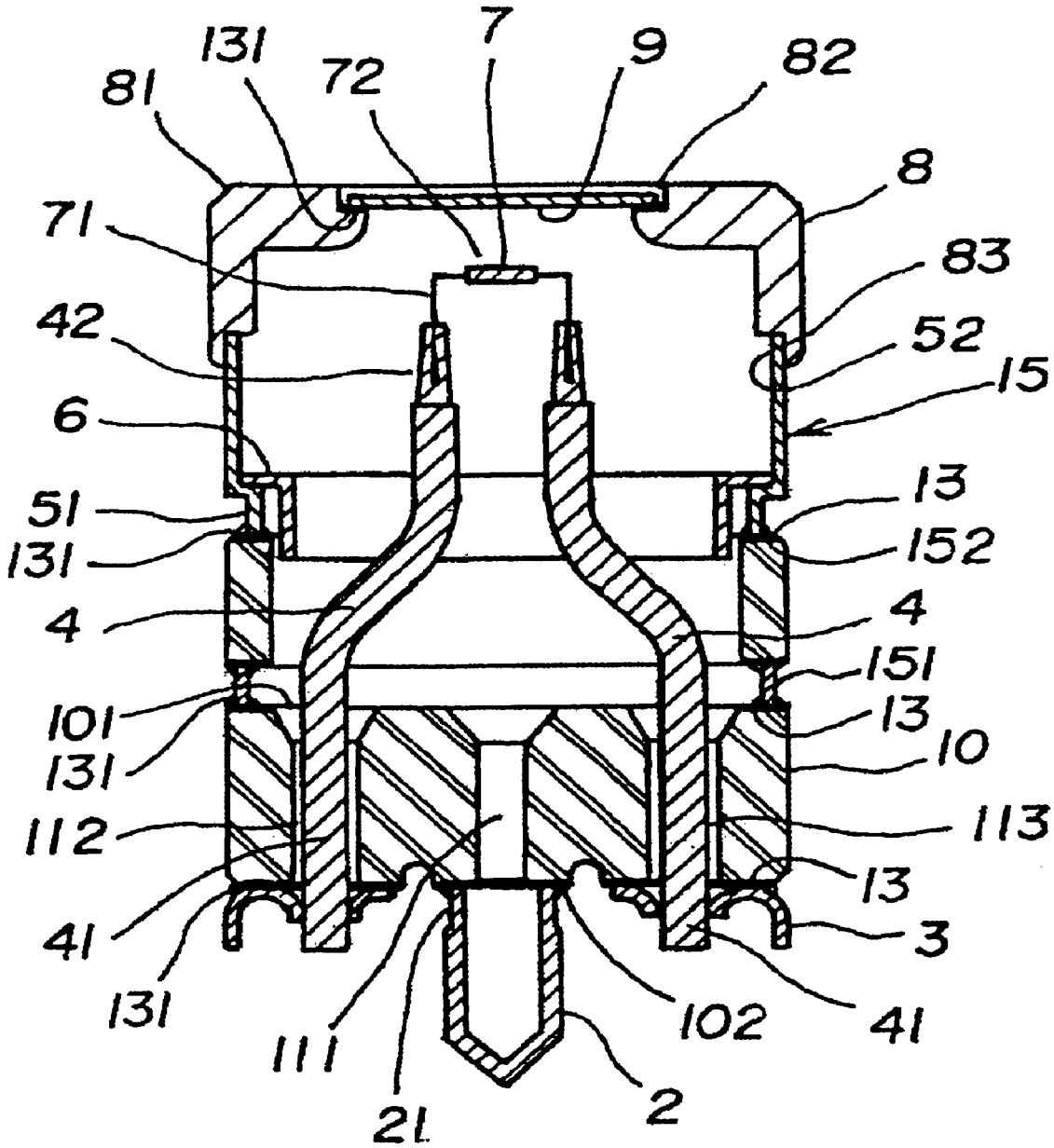
FIG. 4 is a sectional view corresponding to FIG. 2 showing another embodiment of the transmission type X-ray tube in the present invention.
Figure 5:
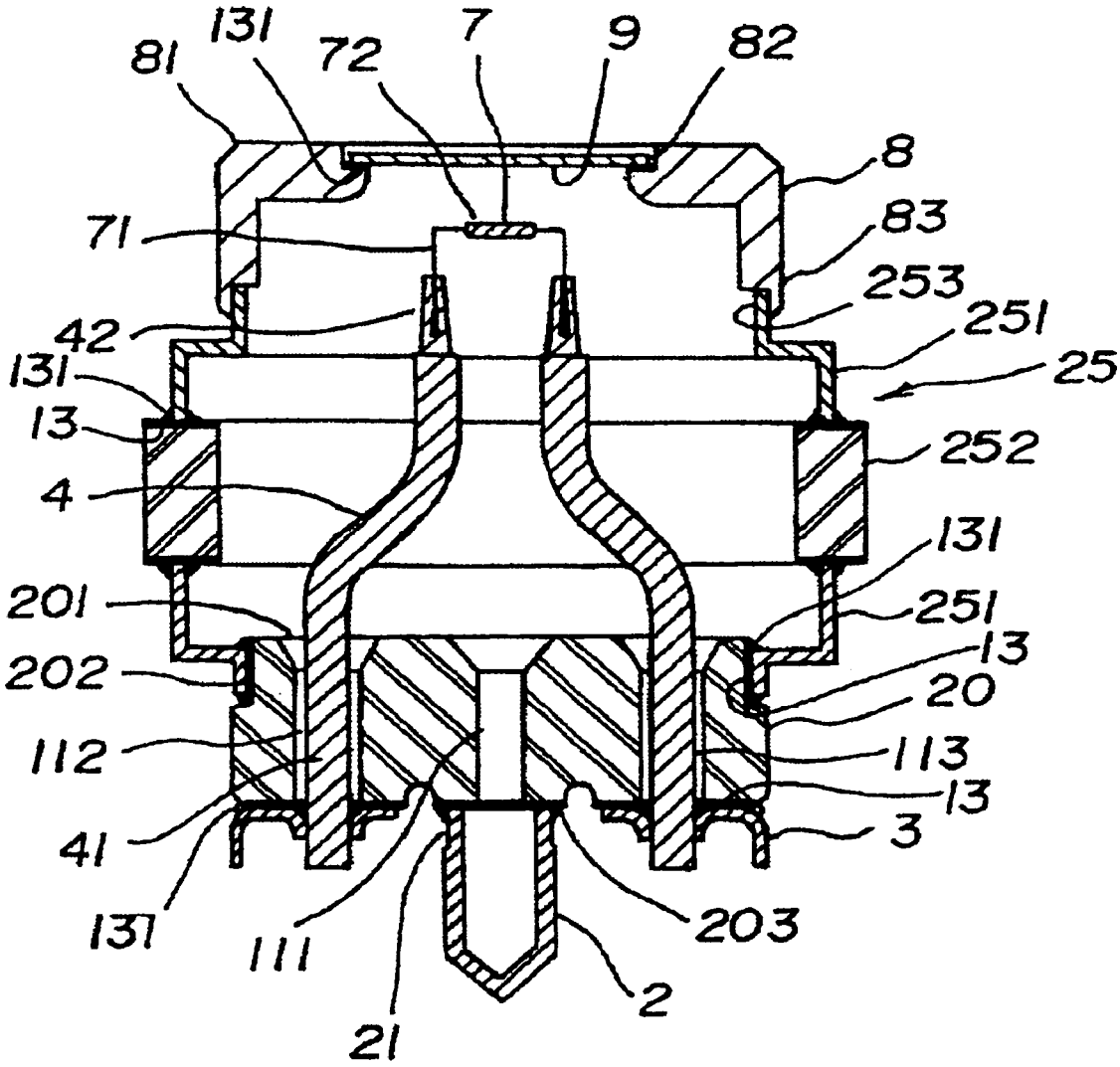
FIG. 5 is a sectional view corresponding to FIG. 2 showing yet another embodiment of the transmission type X-ray tube in the present invention.
Figure 6:
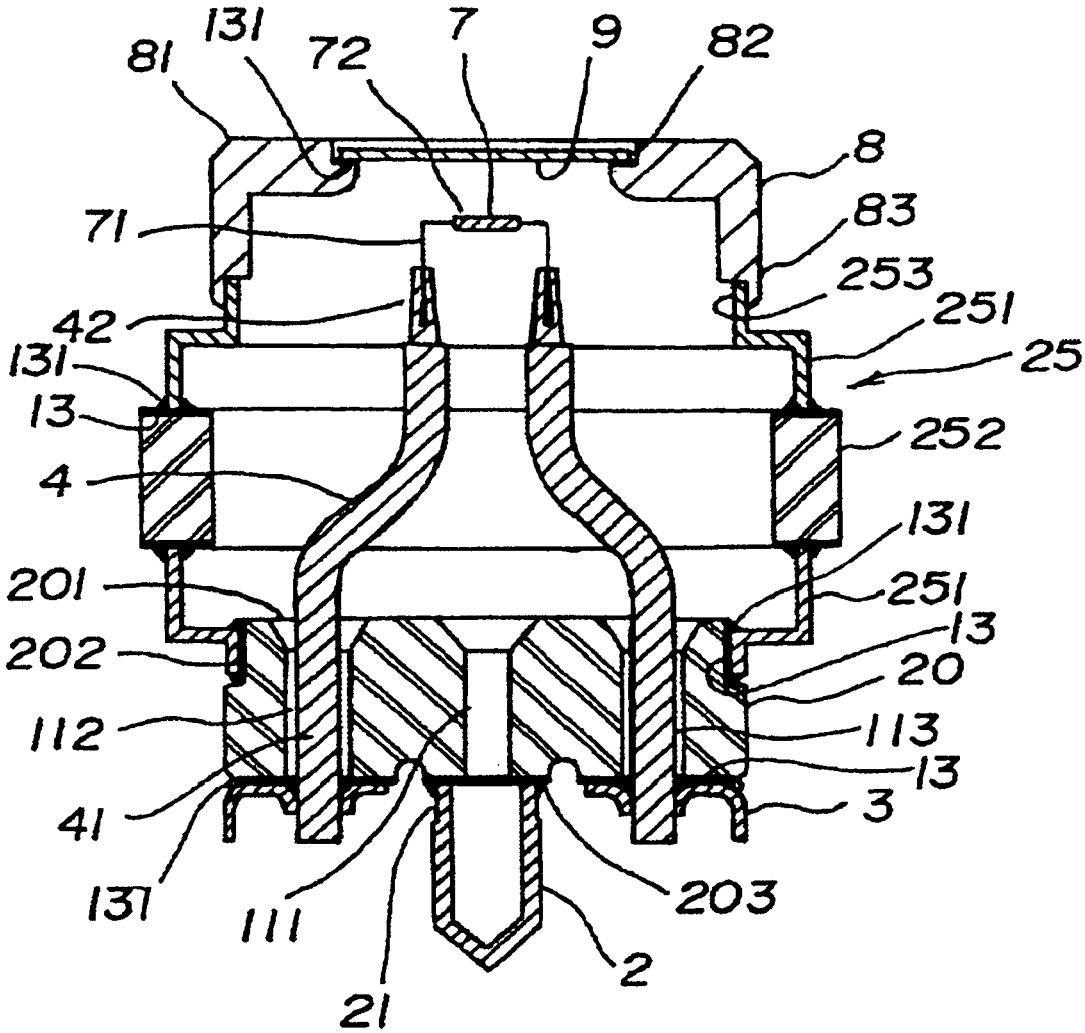
FIG. 6 is a sectional view corresponding to FIG. 2 showing yet another embodiment of the transmission type X-ray tube in the present invention.
Figure 7:
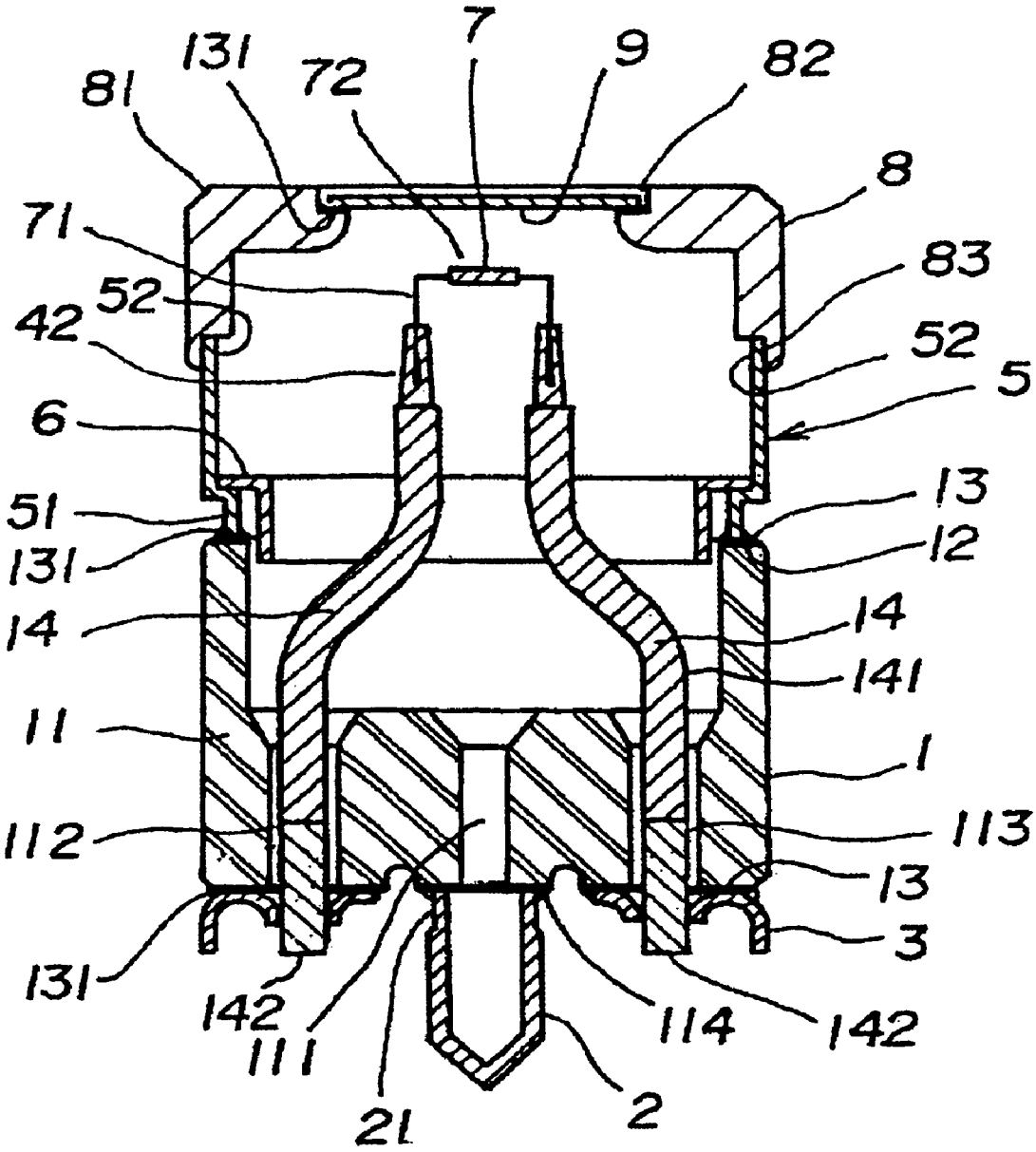
FIG. 7 is a sectional view corresponding to FIG. 2 showing yet another embodiment of the transmission type X-ray tube of the present invention.
Figure 8:
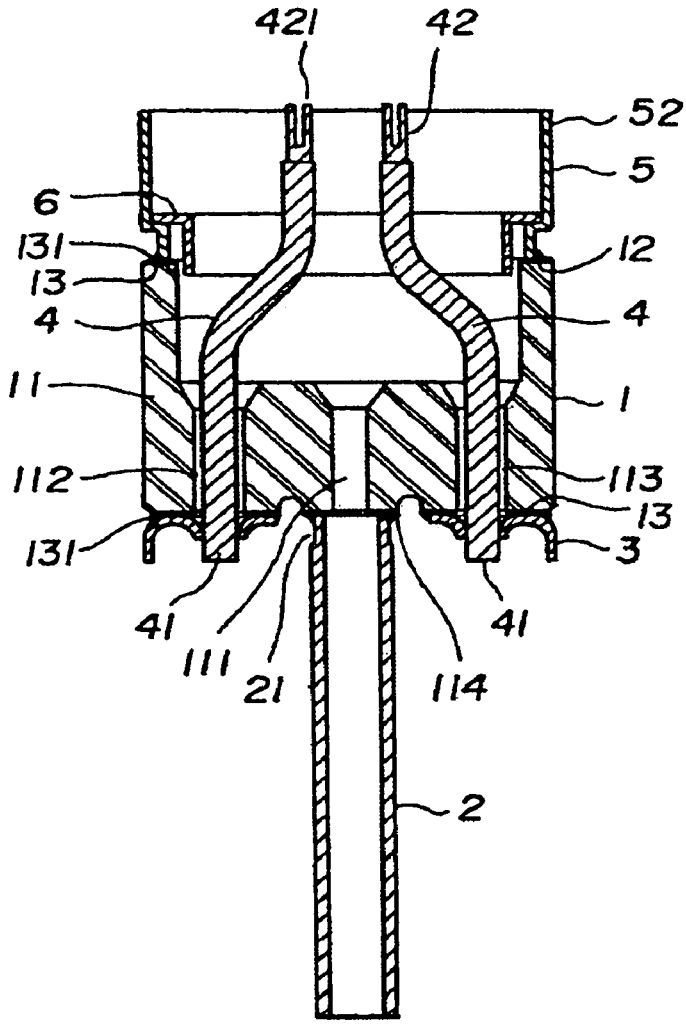
FIG. 8 is a sectional view of an assembly of the stem unit side for illustrating a manufacturing method of the transmission type X-ray in the present invention.
Figure 9:
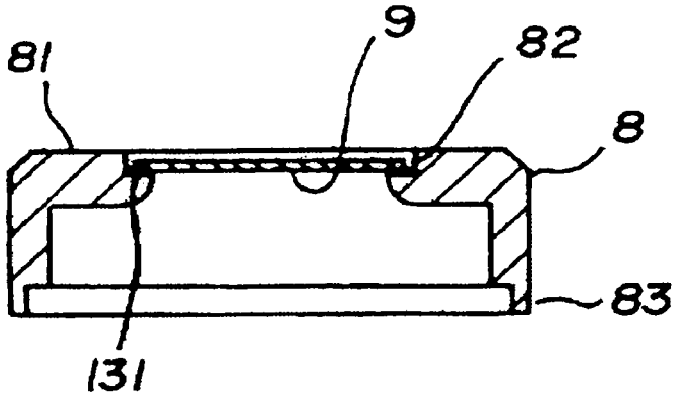
FIG. 9 is a sectional view of an assembly of the window frame side for illustrating the manufacturing method of the transmission type X-ray tube in the present invention.
Figure 10:
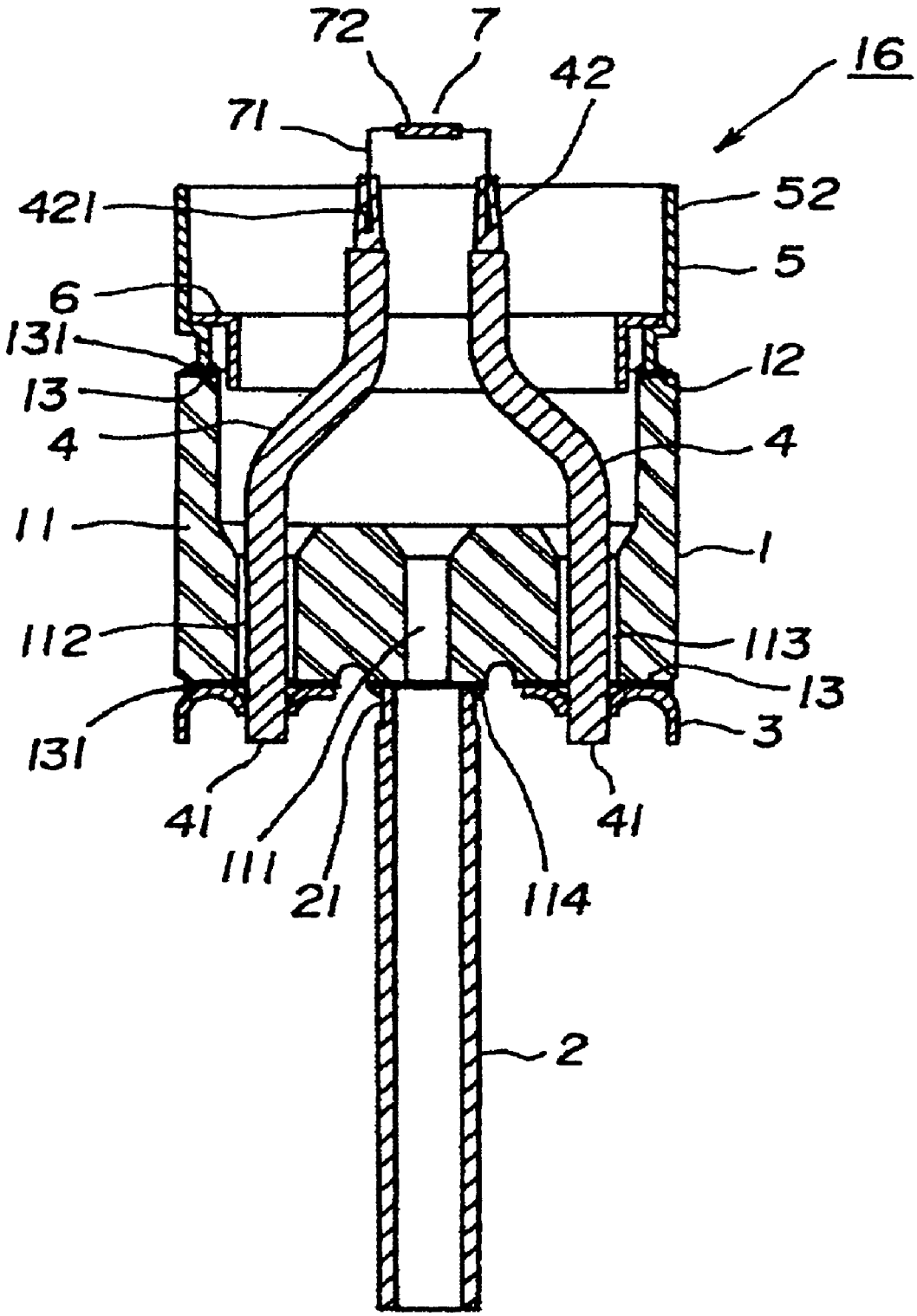
FIG. 10 is a sectional view of a mount assembly for illustrating the manufacturing method of the transmission type X-ray tube in the present invention.
Figure 11:
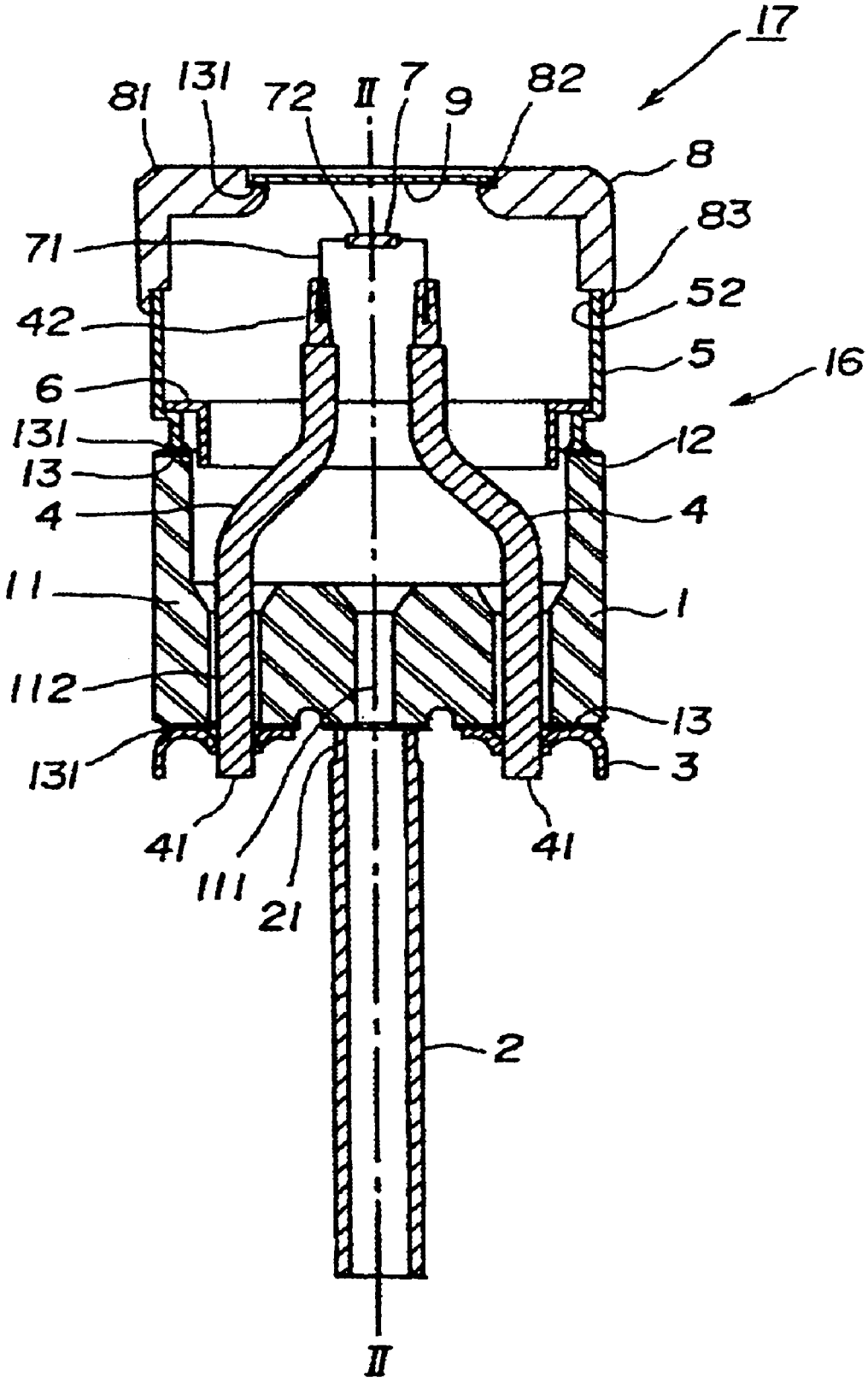
FIG. 11 is a sectional view of a sealed tube for illustrating the manufacturing method of the transmission type X-ray tube in the present invention.
Figure 12:
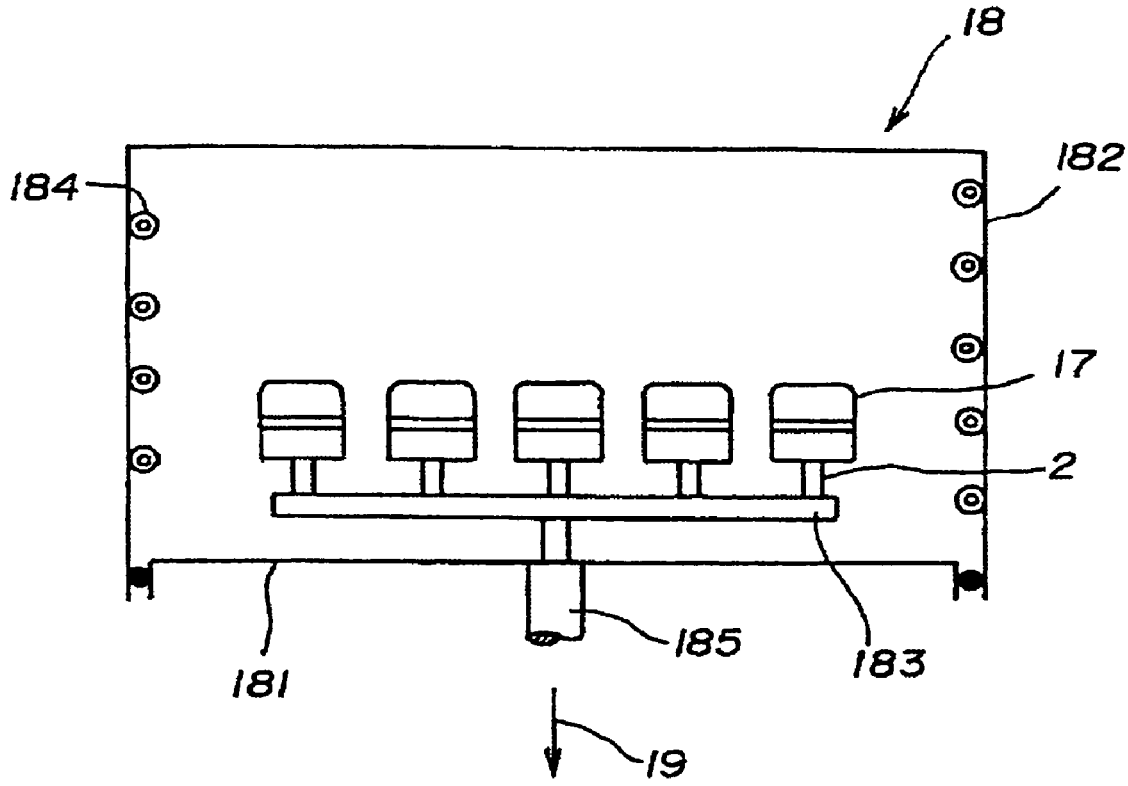
FIG. 12 is a pattern elevational view for showing an example of an exhauster to use for the manufacturing method of the transmission type X-ray in the present invention.
Figure 13:
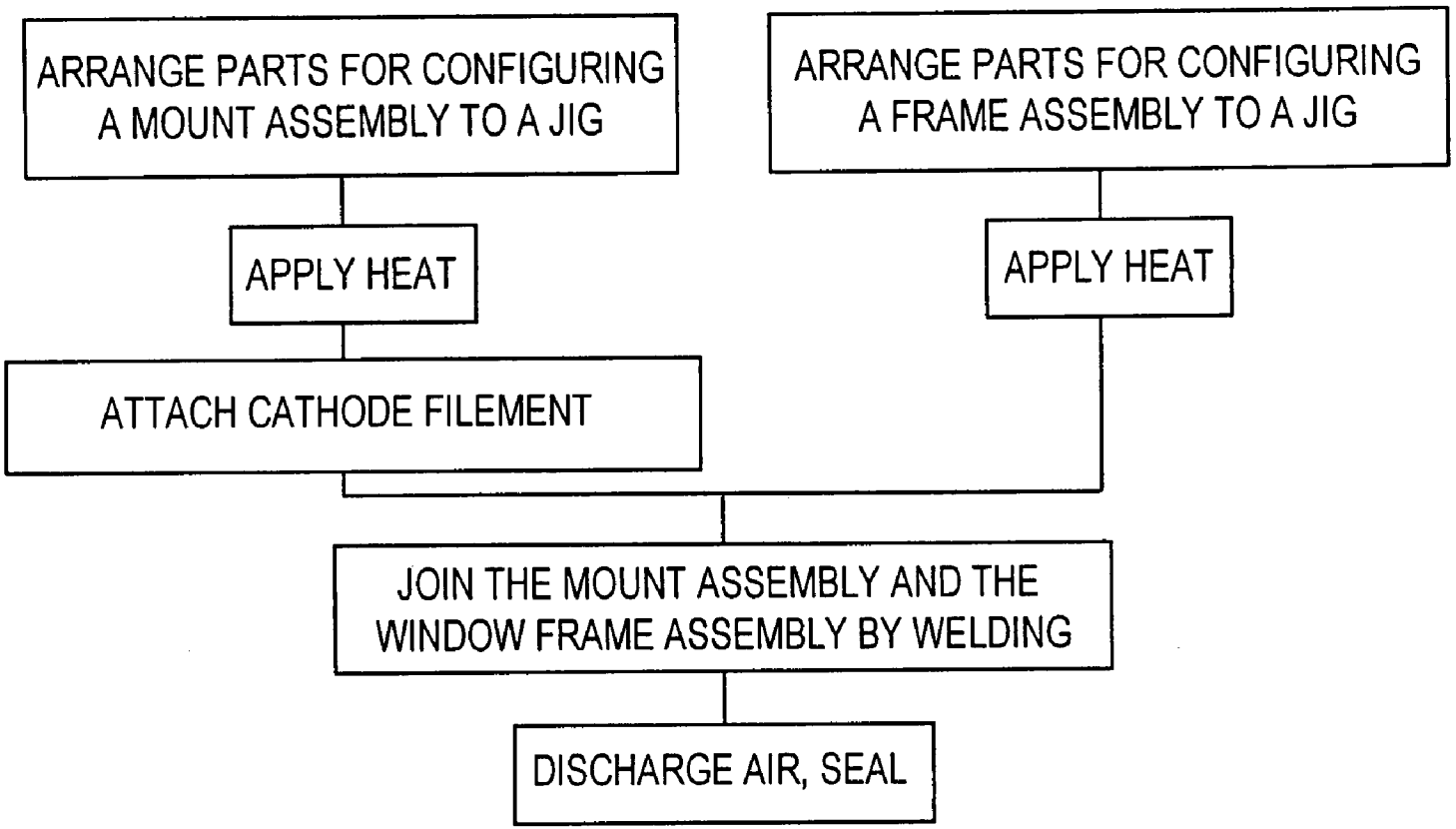
FIG. 13 is a process-flow chart of the manufacturing method for the transmission type X-ray tube in the present invention.

1,10,20 . . . stem unit, 2 . . . exhaust tube, 3 . . . end terminal, 4,14 . . . electrode lead, 5,15,25,35 . . . sealing member, 6 . . . shield, 7 . . . cathode filament, 71 . . . foot portion, 8 . . . irradiating window frame, 9 . . . irradiating window, 111,112, 113 . . . through-hole, 16 . . . mount assembly, 17 . . . unsealed tube, 18 . . . exhauster

The invention claimed is:

1. A manufacturing method for a transmission type X-ray tube comprising:

a stem unit having a plurality of through-holes and is made from insulation material;

a plurality of electrode leads that its one end side is affixed to the stem unit and the other end side is extended so that it is apart from the top surface of the stem unit;

a cathode filament that is affixed to the other end side of the electric lead;

a cupped irradiating window frame that is placed facing the cathode filament and has an aperture on the closed end;

an X-ray transmission irradiating window to which the aperture of the cupped irradiating window frame is air-tightly sealed;

a tubular sealing member that is air-tightly joined to an open end of the cupped irradiating window frame and the other end side to the stem unit; and an exhaust tube that is air-tightly joined to the bottom surface of the stem at one end, the other end side is extended to the direction away from the bottom surface, and is air-tightly sealed after the inside of the tube is vacuum-pumped, wherein the manufacturing method of the transmission type X-ray tube includes:

a step for air-tightly welding the stem unit with each of the electrode lead, exhaust tube and sealing member;

a step for affixing the cathode filament firmly to the side of the other end of the electrode lead;

a step for placing the irradiating window to face the cathode filament and forming the sealed tube by air-tightly welding the open end of the irradiating window frame and the one end side of the sealing member; and a step for sealing the exhaust tube after discharging air inside of the sealed tube via the exhaust tube;

wherein an exhaust operation is carried out by applying heat to a heater, which is attached to an inside wall of an exhaust system that comprises a table and a cover that surrounds plural number of the penetrating X-ray tube, and by turning on electricity to the cathode filament, and activating an exhaust pump at the same time.

2. The manufacturing method of the transmission type X-ray tube according to claim 1, wherein the welding joint of the irradiating window frame and the sealing member is implemented by electric arc welding.

* * * * *